US011492162B2

(12) United States Patent
Myers et al.

(10) Patent No.: US 11,492,162 B2
(45) Date of Patent: Nov. 8, 2022

(54) ADAPTOR BOTTLING LINE ARRANGEMENT INCLUDING THE SAME, AND METHOD OF FILLING AND SEALING IN A BOTTLE LINE ARRANGEMENT

(71) Applicant: CSP TECHNOLOGIES, INC., Auburn, AL (US)

(72) Inventors: Kasey Myers, Auburn, AL (US); Ethan Ross Perdue, Auburn, AL (US); G. F. Alexia Gleason, Madison, WI (US)

(73) Assignee: CSP Technologies, Inc., Auburn, AL (US)

( * ) Notice: Subject to any disclaimer, the term of this patent is extended or adjusted under 35 U.S.C. 154(b) by 72 days.

(21) Appl. No.: 16/488,490

(22) PCT Filed: Feb. 23, 2018

(86) PCT No.: PCT/US2018/019309

§ 371 (c)(1),
(2) Date: Aug. 23, 2019

(87) PCT Pub. No.: WO2018/156823

PCT Pub. Date: Aug. 30, 2018

(65) Prior Publication Data

US 2019/0375531 A1 Dec. 12, 2019

Related U.S. Application Data

(60) Provisional application No. 62/463,117, filed on Feb. 24, 2017.

(51) Int. Cl.
*B65B 43/54* (2006.01)
*B65B 3/00* (2006.01)
(Continued)

(52) U.S. Cl.
CPC ..... *B65B 43/54* (2013.01); *B65B 3/003* (2013.01); *B65B 7/26* (2013.01); *B65B 43/38* (2013.01)

(58) Field of Classification Search
CPC ..... B65B 7/26; B65B 43/38; B65B 5/103; B65B 3/003; B65B 19/20; B65B 2220/04
(Continued)

(56) References Cited

U.S. PATENT DOCUMENTS 4,807,425 A * 2/1989 Abrams ..... B65B 43/38 53/381.4
5,271,897 A * 12/1993 Wurschum ..... B01L 3/50853 422/561
(Continued)

FOREIGN PATENT DOCUMENTS

DE 102010029136 A1 11/2011
WO 20120001581 A1 1/2012

*Primary Examiner* — Anna K Kinsaul
*Assistant Examiner* — Himchan Song
(74) *Attorney, Agent, or Firm* — Mark T. Vogelbacker; Eckert Seamans Cherin & Mellott, LLC

(57) ABSTRACT

An adapter is configured to hold a flip-top vial. The vial includes a body and a lid. The body of the vial has a base and a sidewall extending therefrom. The body defines an interior including a product space configured for housing at least one product and having an opening leading to the interior. The lid is configured to be attached to the sidewall by a hinge. The adapter includes a receiving portion having an opening configured to receive the body, and a base portion extending from the receiving portion. The base portion has a shelf portion proximate the opening. The shelf portion is configured to engage the lid of the vial when the lid is in a predetermined opened position in order to maintain the lid in the predetermined opened position with respect to the body.

14 Claims, 10 Drawing Sheets

(51) Int. Cl.
*B65B 7/26* (2006.01)
*B65B 43/38* (2006.01)

(58) Field of Classification Search
USPC ..... 53/468
See application file for complete search history.

(56) References Cited

U.S. PATENT DOCUMENTS

| | | | | |
|---|---|---|---|---|
| 5,356,071 | A * | 10/1994 | Schmissrauter | B65D 5/4208 229/160 |
| 6,531,096 | B1 * | 3/2003 | Deveney | B65B 69/00 422/549 |
| 2007/0084744 | A1 * | 4/2007 | Appelbaum | B65B 51/10 206/462 |
| 2012/0186200 | A1 | 7/2012 | Jones | |
| 2016/0158103 | A1 * | 6/2016 | Ohsumi | B65B 53/02 53/441 |
| 2017/0095403 | A1 * | 4/2017 | Larson | B65D 25/205 |
| 2019/0135463 | A1 * | 5/2019 | Noda | B65B 5/04 |

* cited by examiner

ADAPTOR BOTTLING LINE ARRANGEMENT INCLUDING THE SAME, AND METHOD OF FILLING AND SEALING IN A BOTTLE LINE ARRANGEMENT

CROSS-REFERENCE TO RELATED APPLICATIONS

This application is a U.S. National Phase of International Application No. PCT/US2018/019309 filed Feb. 23, 2018, which claims priority to U.S. Provisional Patent Application No. 62/463,117 filed Feb. 24, 2017, which are each incorporated herein by reference in their entireties.

FIELD OF THE DISCLOSED CONCEPT

The disclosed concept relates to adapters. The disclosed concept also relates to bottling line arrangements including adapters. The disclosed concept further relates to methods of filling and sealing in a bottling line using a bottling line arrangement.

BACKGROUND

Systems for filling and capping round bottles and vials are very well known. Such systems are designed for automatic filling and include conveyers for moving the bottles from a filling station to a capping station. The conveyers are typically designed to provide turns from one station to the next. Stations can include filling, capping, labelling, shrink banding, and sometimes other functions. Typical bottling lines are not capable of filling and capping flip-top vials efficiently and at high throughput rates. Such typical bottling lines do not include means to orient bottles rotationally. Flip-top vials need to be angled at the hinge to ensure that the cap moves only toward a fully closed position when touched and must be predictably oriented and spaced. Such vials must flow by conveyor track and not tip over, must be open, and must be predictably oriented and spaced.

Until this time a solution to the problem of filling and capping flip-top vials on conventional bottling lines in a very cost efficient manner has not been available.

SUMMARY OF THE DISCLOSED CONCEPT

As one aspect of the disclosed concept, an adapter configured to hold a flip-top vial is provided. The vial includes a body and a lid. The body of the vial has a base and a sidewall extending therefrom. The body defines an interior including a product space configured for housing at least one product and having an opening leading to the interior. The lid is configured to be attached to the sidewall by a hinge. The adapter comprises a receiving portion having an opening configured to receive the body, and a base portion extending from the receiving portion. The base portion has a shelf portion proximate the opening. The shelf portion is configured to engage the lid of the vial when the lid is in a predetermined opened position in order to maintain the lid in the predetermined opened position with respect to the body.

As another aspect of the disclosed concept, a bottling line arrangement is provided. The bottling line arrangement comprises the aforementioned adapter, a holder, and the flip-top vial. The body is located in the receiving portion. The adapter is located in the holder.

As another aspect of the disclosed concept, a method of filling and sealing in a bottling line utilizing the aforementioned bottling line arrangement is provided. The method comprises the steps of inserting the body of the vial into the receiving portion of the adapter, disposing the lid of the vial on the shelf portion, the lid being in the predetermined opened position, filling the product space of the body of the vial with the at least one product, and moving the lid off of the shelf portion and onto the sidewall of the body in order to seal the at least one product within the vial.

BRIEF DESCRIPTION OF THE DRAWINGS

Exemplary embodiments of the present disclosed concept are shown in the enclosed drawings as follows.

DETAILED DESCRIPTION OF THE PREFERRED EMBODIMENTS

As employed herein, the term "component" shall mean a single unitary piece or element that does not require separate assembly steps. For example and without limitation, a molded piece is a "component." Additionally, a piece that is manufactured by overmolding or co-molding one element onto another element is a "component." However, a piece that comprises several elements that must be separately assembled together is not a "component."

As employed herein, the statement that two or more parts or components "engage" one another shall mean that the parts exert a force against one another either directly or through one or more intermediate parts or components.

As employed herein, the term "number" shall mean one or an integer greater than one.

FIGS. 1-5 are different views of an adapter 2, in accordance with one non-limiting embodiment of the disclosed concept. As will be discussed in greater detail below, adapter 2 allows a vial (e.g., without limitation, flip-top vial 100, shown in FIGS. 6-11D) to be filled with at least one product (e.g., pills and the like) and sealed in a more efficient and economical manner than existing methods. In one exemplary embodiment, adapter 2 is a unitary component made of a single piece of material. For example and without limitation, adapter 2 may be a single injection molded piece made by an injection-molding process. Adapter 2 may also be machined from a stock of material by conventional methods.

Figure 1:
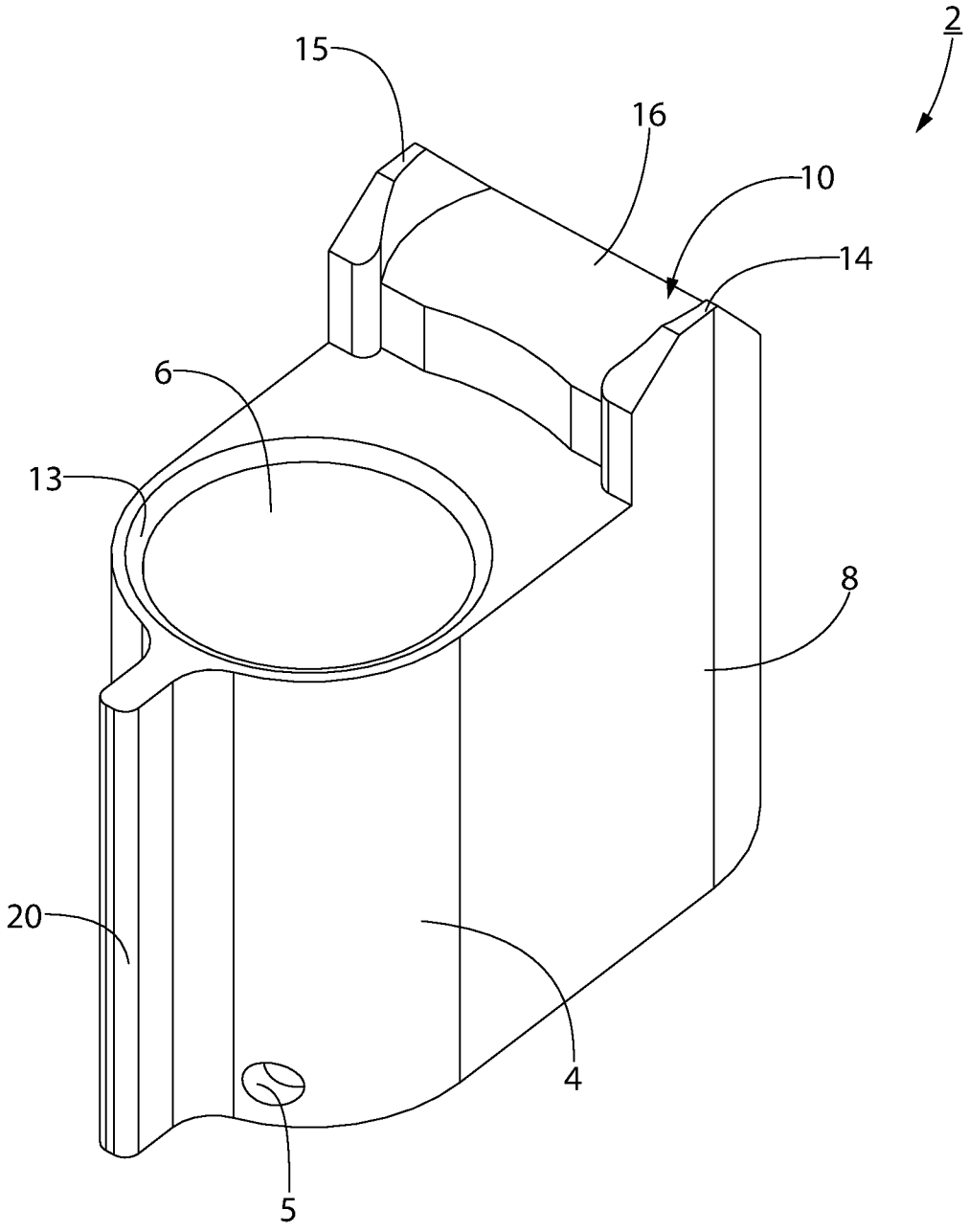
FIG. 1 is an isometric view of an adapter, in accordance with one non-limiting embodiment of the disclosed concept.
Figure 2:
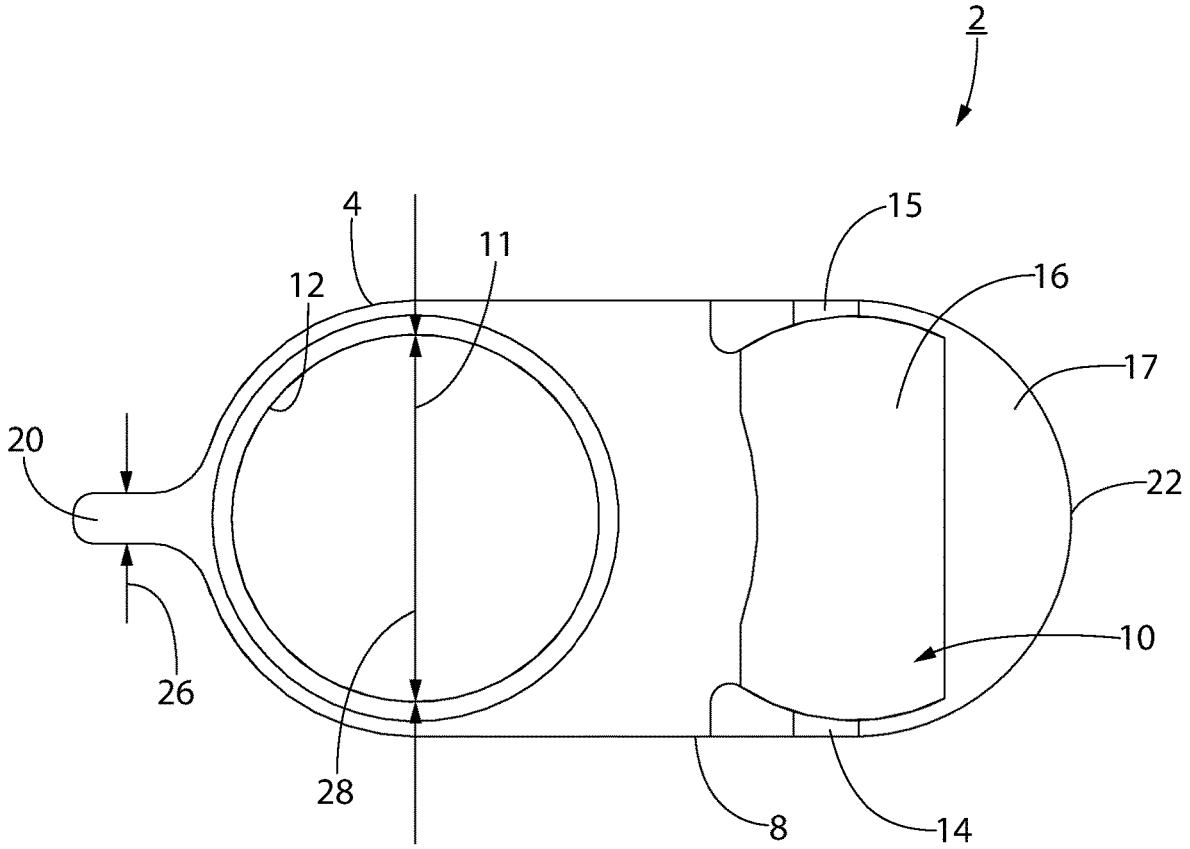
FIGS. 2-5 are top, left, right, and bottom views, respectively, of the adapter of FIG. 1.
Figure 3:
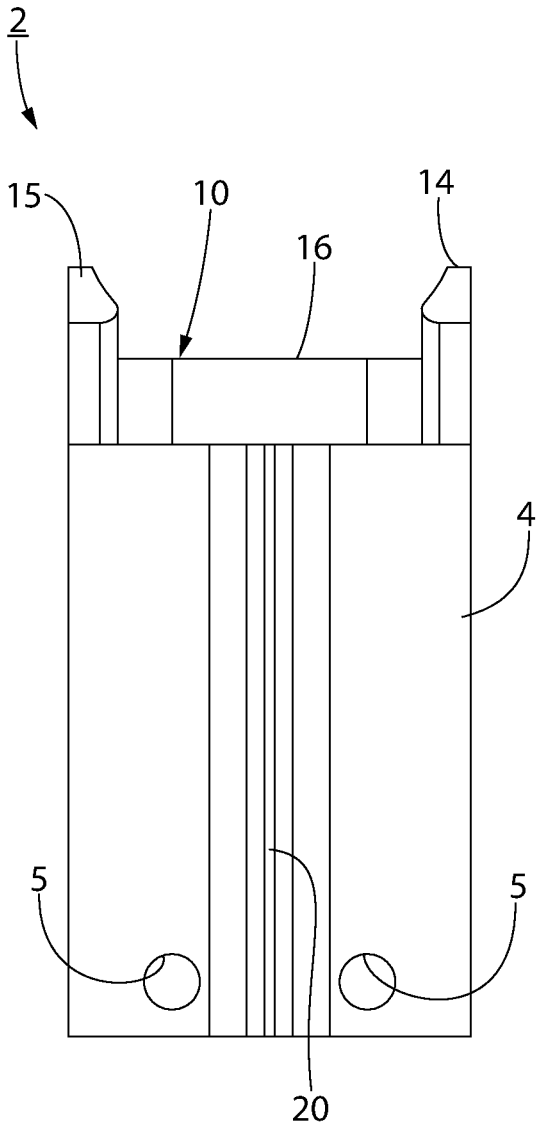

Adapter 2 includes a receiving portion 4, a base portion 8 extending from receiving portion 4, and a tail portion 20 extending from receiving portion 4 away from base portion 8. Base portion 8 and tail portion 20 are located on opposing sides of receiving portion 4. Receiving portion 4 has an opening 6, and base portion 8 has a shelf portion 10 proximate opening 6. As shown in FIG. 2, receiving portion 4 further has a closed bottom 11, a tubular-shaped surface 12 extending from bottom 11, and open top 13 located opposite bottom 11. Thus, receiving portion 4 is well suited to receive and maintain vial 100, as will be discussed below. In one exemplary embodiment, tubular-shaped surface 12 and tail portion 20 each extend from proximate bottom 11 to proximate top 13. However, it is within the scope of the disclosed concept for an adapter to have suitable alternative geometries (e.g., without limitation, having a tail portion that only extends from a middle of a receiving portion), without departing from the scope of the disclosed concept. Furthermore, as shown most clearly in FIG. 2, base portion 8 has a distal exterior surface 22 located opposite and distal tail portion 20. For reasons that will be discussed below, exterior surface 22 is concave facing tail portion 20 (or convex facing away from tail portion 20.

Figure 6:
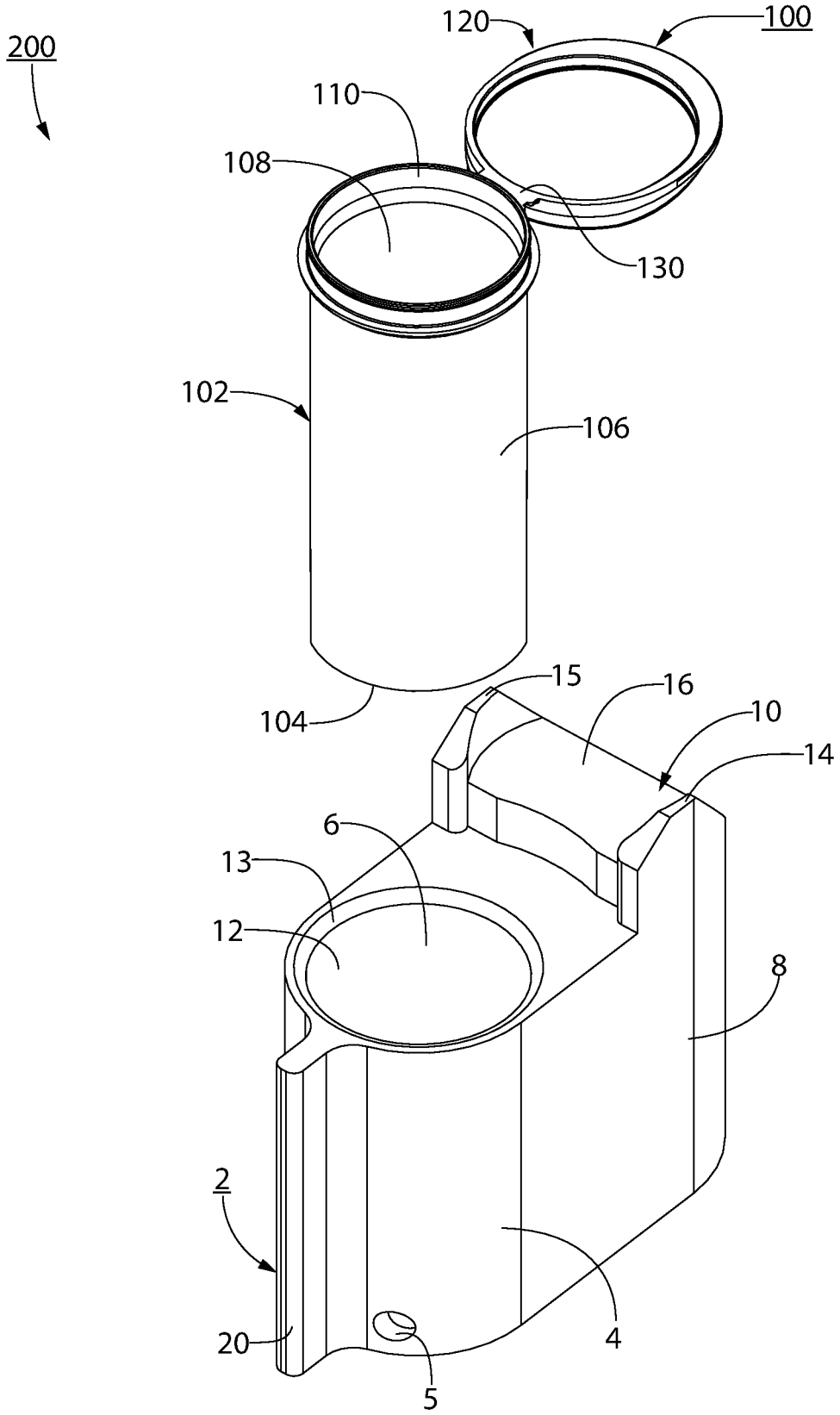
FIGS. 6 and 7 are exploded isometric and assembled isometric views, respectively, of a portion of a bottling line arrangement including the adapter of FIGS. 1-5.
Figure 7:
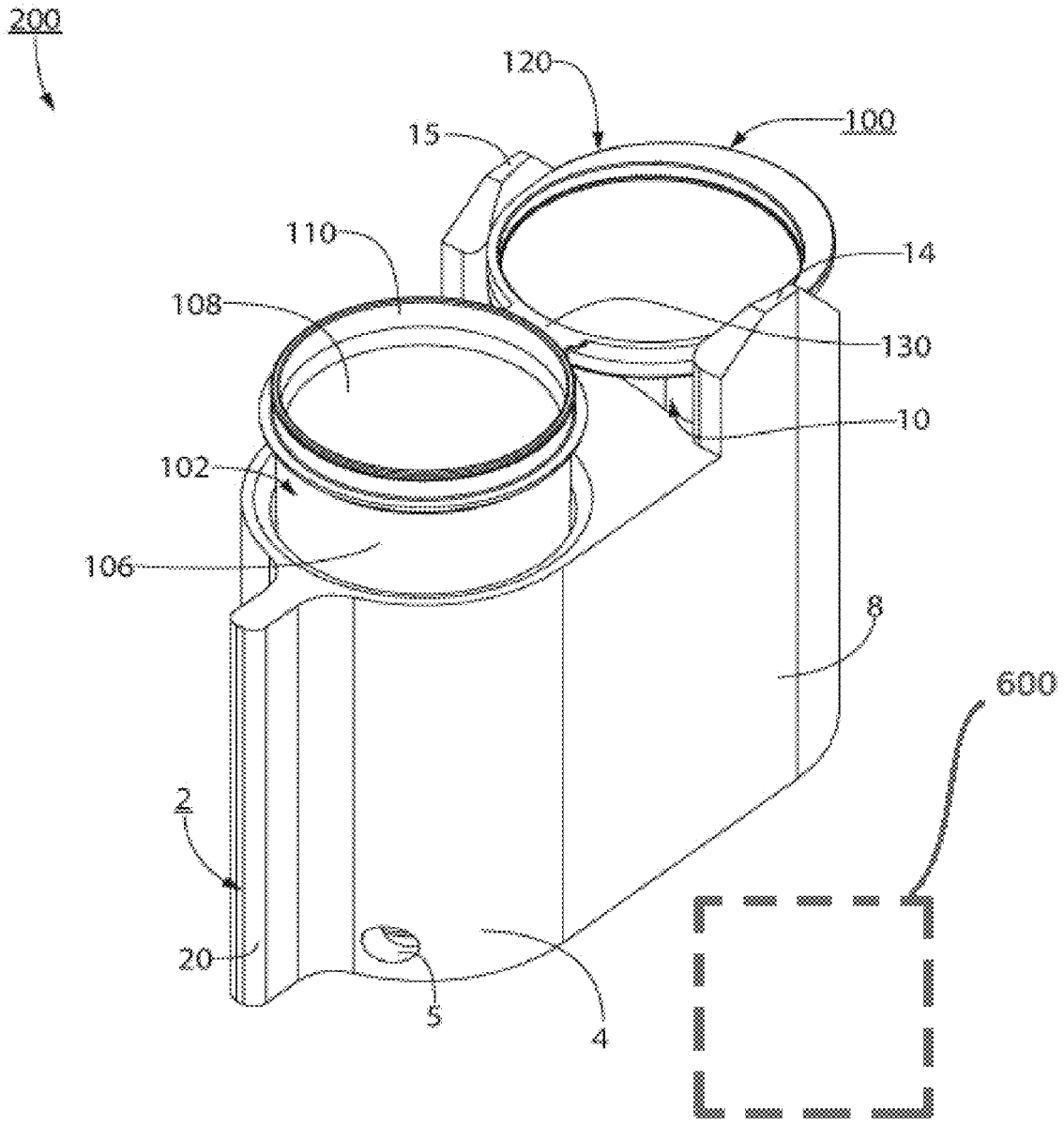
Figure 8:
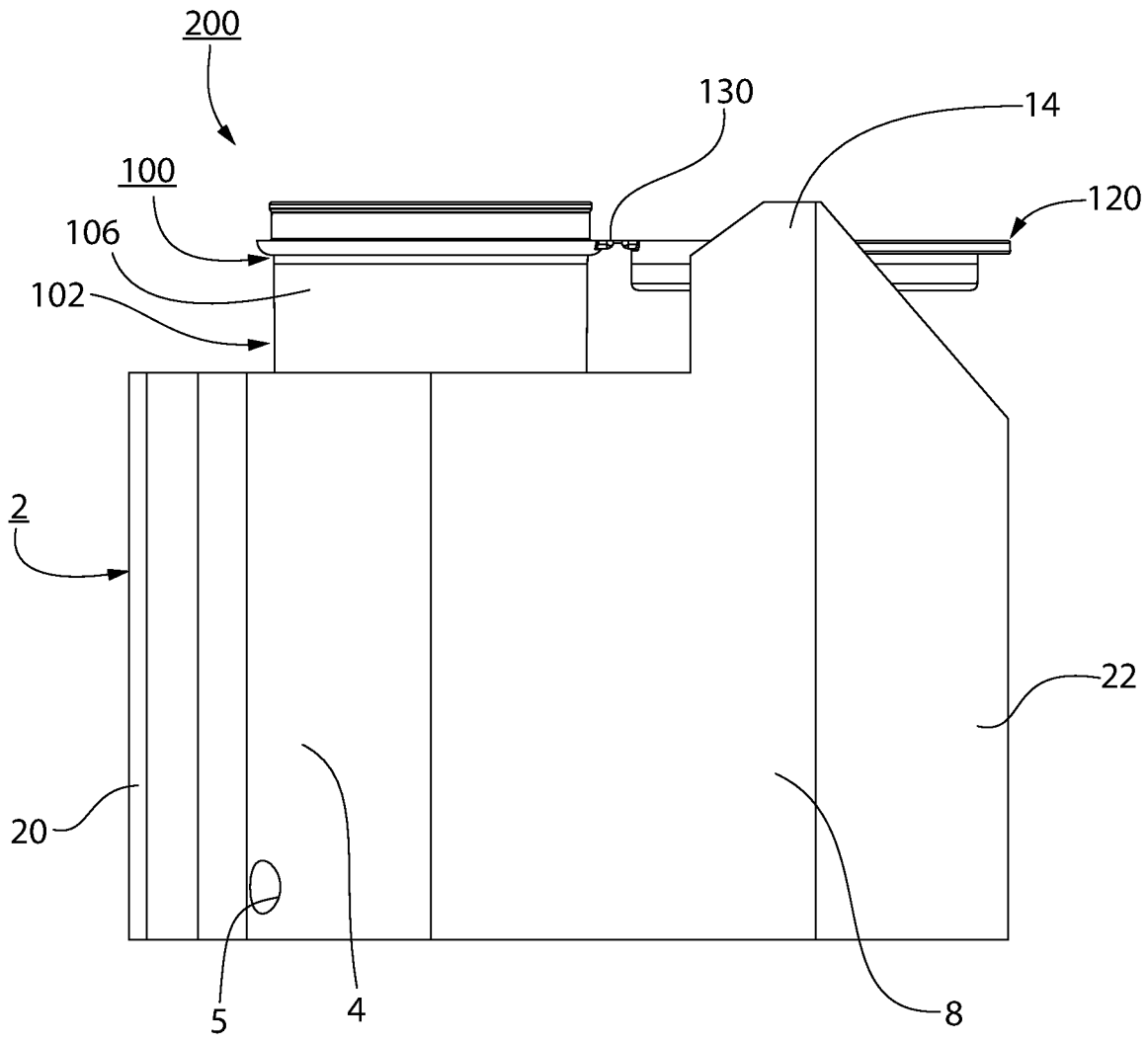
FIG. 8 is a front view of the assembled bottling line arrangement of FIGS. 6 and 7.
Figures 9A, 9B, 9C, 9D:
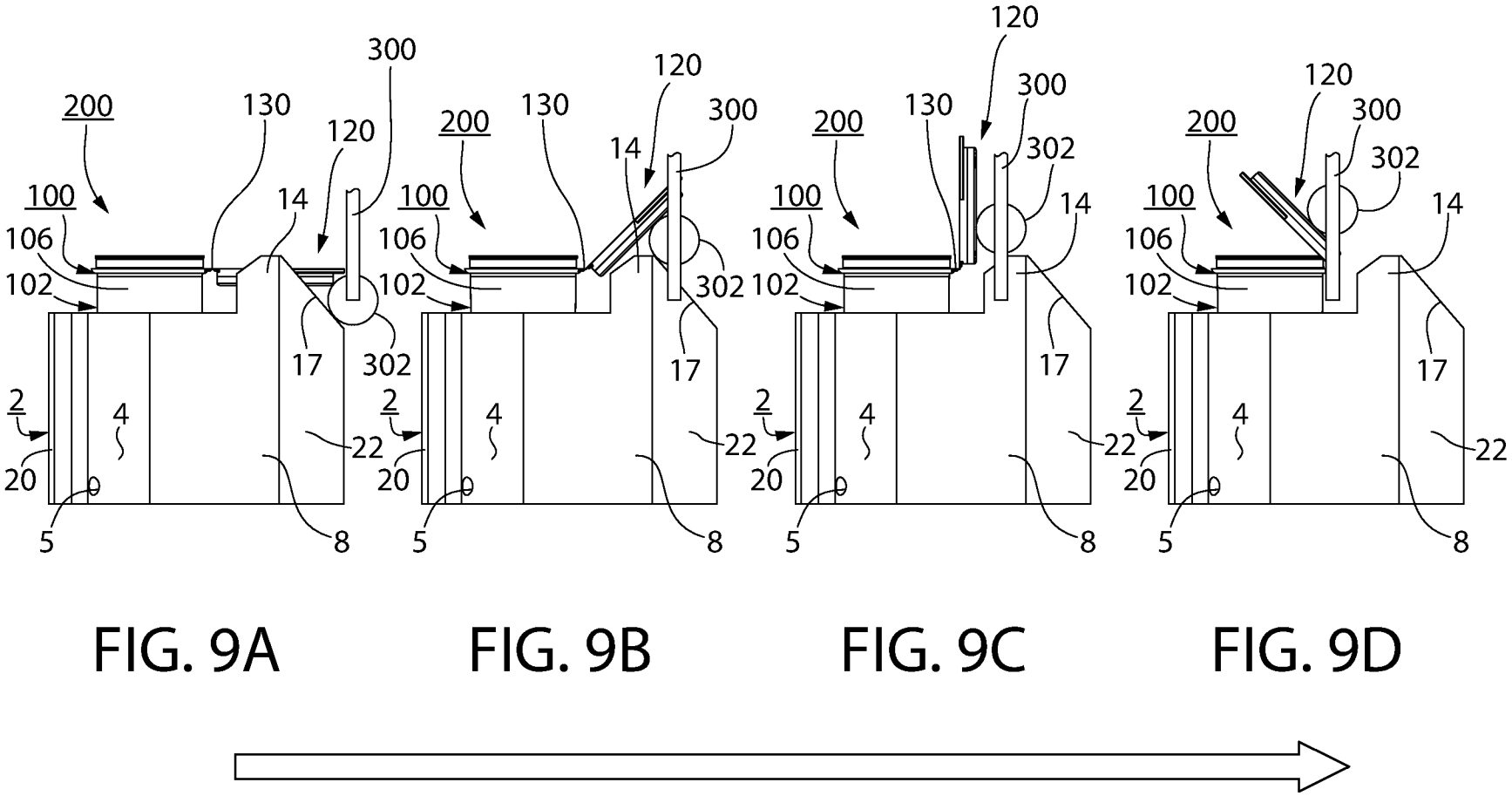
FIGS. 9A-9D show front views of the bottling line arrangement of FIG. 8 at different stages during filling and sealing of the vial.

FIGS. 6-8 are different views of a portion of a bottling line arrangement 200, in accordance with one non-limiting embodiment of the disclosed concept. Bottling line arrangement 200 includes adapter 2, vial 100, and a holder 600 (shown schematically in FIG. 7). Adapter 2 is configured to be located in the holder 600. Vial 100 includes a body 102 and a lid 120. Body 102 of vial 100 has a base 104 and a sidewall 106 extending from base 104. As shown, lid 120 is attached to sidewall 106 by a hinge 130. Furthermore, body 102 defines an interior 108 including a product space configured for housing at least one product and having an opening 110 leading to interior 108.

In operation, opening 6 of receiving portion 4 is configured to receive body 102 of vial 100 such that body 102 is located in receiving portion 4. In this position, tubular-shaped surface 12 of receiving portion 4 is located external and is concentric with respect to sidewall 106 of body 102. Additionally, shelf portion 10 of adapter 2 is configured to engage lid 120 of vial 100 when lid 120 is in a predetermined opened position in order to maintain lid 120 in the predetermined opened position with respect to body 102. Accordingly, vial 100 is configured to be maintained by adapter 2 in the predetermined opened position with lid 120 engaging shelf portion 10. In one exemplary embodiment, lid 120 of vial 100 is not biased toward a closed position, with respect to body 102. That is, lid 120 may remain in an opened position (e.g., without limitation, disposed generally at an angle between 160 and 200 degrees with respect to opening 110 of body 102 (see FIGS. 7 and 8)) until acted upon by an outside force. In this manner, and as seen in FIG. 7, shelf portion 10 reliably minimizes and/or prevents any side to side movement of lid 120 with respect to body 102.

More specifically, shelf portion 10 includes a first wall portion 14, a second wall portion 15 located opposite first wall portion 14, and a platform 16 extending between and being located substantially perpendicular to first and second wall portions 14,15. When vial 100 is in the predetermined opened position, lid 120 engages and extends between first and second wall portions 14,15. As such, engagement between lid 120 and first and second wall portions 14,15 prevents such movement. First and second wall portions 14,15, and platform 16, each extend from proximate opening 6 of receiving portion 4 away from closed bottom 11 of receiving portion. Accordingly, as shown in FIGS. 7-11D, vial 100 is configured to protrude outwardly from receiving portion 4. It will be appreciated that this configuration/geometry advantageously allows vial 100 to be capped and sealed in an efficient and economical manner.

Adapter 2 is also configured to be employed in a relatively streamlined automation process. That is, when multiple substantially identical adapters are used to fill and seal multiple bottles in a bottling line, the geometry of each individual adapter allows them to be conveniently moved along conveyor belts and the like. Specifically, when used in automation, each tail portion (e.g., tail portion 20) of an adapter is configured to engage a corresponding distal exterior surface (e.g., exterior surface 22) of an adjacent adapter. In this manner, when the adapters are moved on conveyor belts and take turns going from station to station, adjacent adapters can advantageously have appropriate space between them, and can make the turns smoothly due to the concave (or convex) nature of their distal exterior surfaces. Furthermore, the tail portions are advantageously able to achieve this function by virtue of their relatively narrow width, as compared to the diameter of the receiving portion. In one illustrative embodiment, and as shown in FIG. 2, tail portion 20 has a width 26 and receiving portion 4 has a diameter 28 at least five times greater than width 26.

Additionally, adapter 2 has a mechanism to allow vial 100 to be easily inserted into and removed from receiving portion 4. Specifically, as shown, receiving portion 4 has a number of thru holes 5. It will be appreciated that rather than having a partial vacuum occur when a vial is inserted into a receiving portion, thru holes minimize such an undesirable situation by providing a pathway for air to enter and exit the receiving portion. As a result, vial 100 can be relatively easily inserted into and removed from receiving portion 4 with minimal gas pressures inhibiting such movement.

Figure 4:
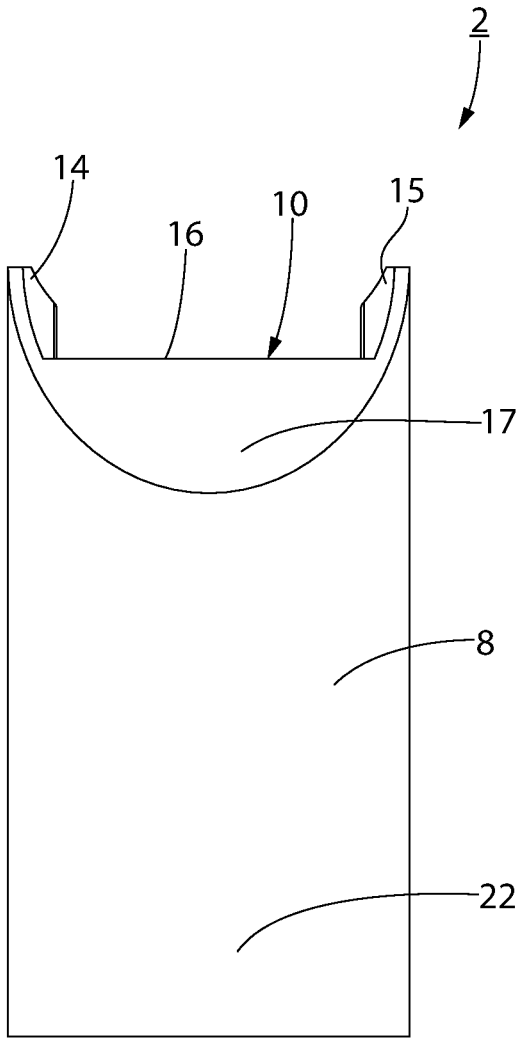
Figure 5:
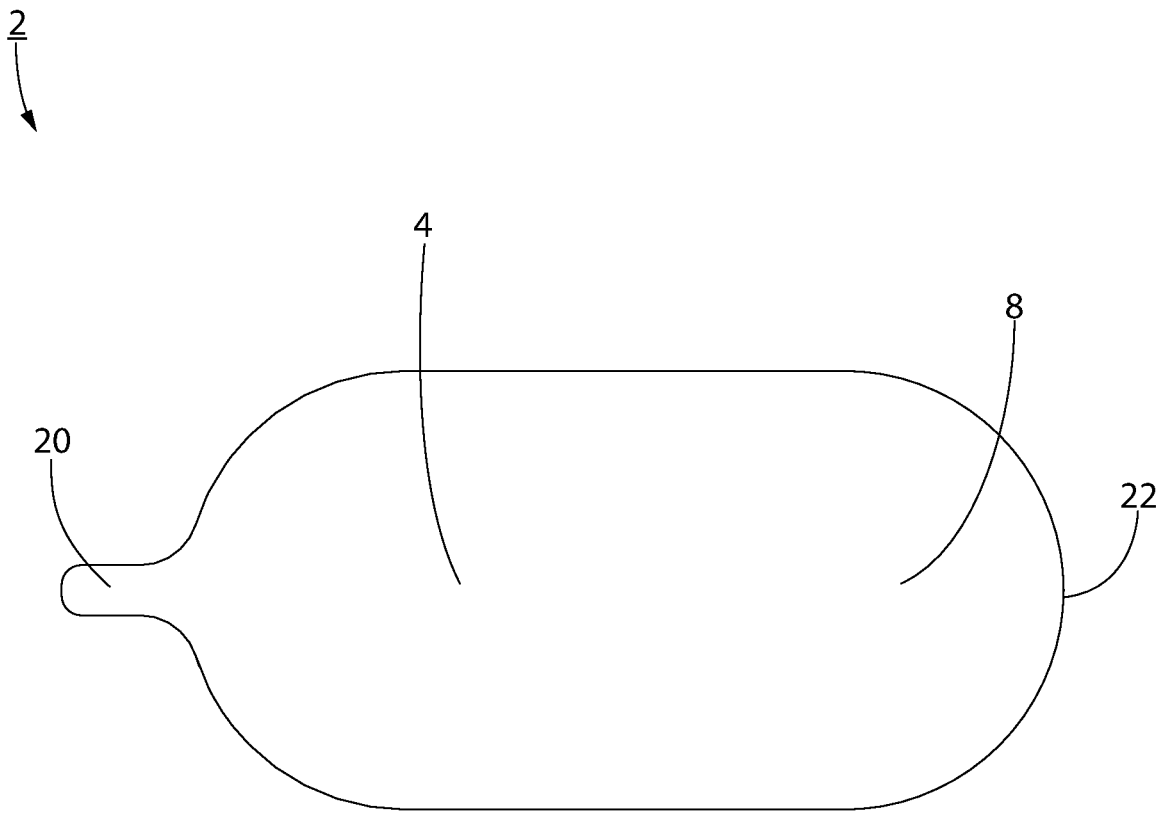

Adapter 2 is also structured to allow lid 120 to move to a closed position in a relatively efficient manner Specifically, as shown in FIGS. 2 and 4, adapter 2 further includes a planar surface 17 extending from first wall portion 14, second wall portion 15, and platform 16 away from receiving portion 4. It will be appreciated that planar surface 17 is located at an obtuse angle with respect to platform 16. As a result, and referring to FIGS. 9A-9D, when employed in automation, lid 120 can relatively easily be moved toward a closed position.

In one illustrative embodiment, a tool 300 including a roller 302 is employed to move lid 120. As such, and as can be seen when viewing vial 100 from a first position to a subsequent position, FIGS. 9A-9D respectively, when adapter 2 is moved past tool 300 (i.e., moves to the right with respect to FIGS. 9A-9D), roller 302 rolls up surface 17 and engages lid 120 in order to move lid 120 from the predetermined opened position toward the closed position. It will, however, be appreciated that any suitable alternative tool (e.g., without limitation, an air gun and/or a brush) may be employed in order to perform the desired function of initially moving lid 120 from the fully opened position toward the closed position. Furthermore, although the disclosed concept has been shown in accordance with roller 302 moving lid 120 from a first position (FIG. 9A) wherein lid 120 is at about a 180 degree angle with respect to the opening of body 102, to a second position (FIG. 9D) wherein lid 120 is at an angle of less than 90 degrees with respect to the opening of body 102, it will be appreciated that roller 302, or a similar alternative tool, may only move lid 120 to an angle of about 90 degrees with respect to the opening of body 102, without departing from the scope of the disclosed concept.

Figures 10A, 10B, 10C, 10D:
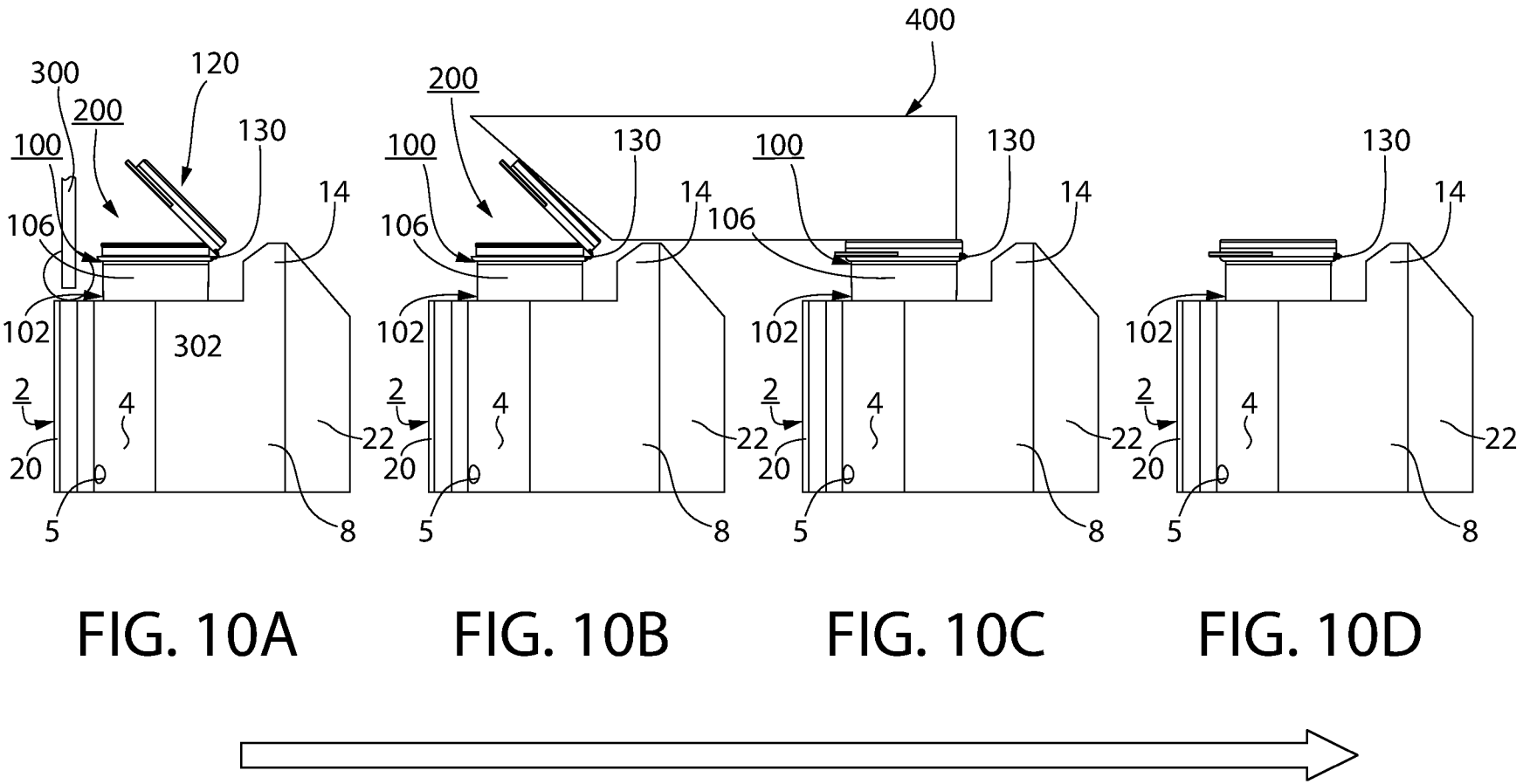
FIGS. 10A-10D show front views of the bottling line arrangement of FIGS. 9A-9D at subsequent stages during filling and sealing of the vial.

In one illustrative embodiment, and referring to FIGS. 10A-10D, once tool 300 has passed adapter 2 and vial 100, another tool 400 may be employed to fully move lid 120 to the closed position. As shown in FIGS. 10A-10D, when adapter 2 and vial 100 are moved from a first position to a subsequent position, FIGS. 10A-10D respectively, tool 400 moves into engagement with lid 120 and moves it from a partially closed position (i.e., as a result of tool 300) to a fully closed position, as depicted in FIGS. 10C and 10D.

Figures 11A, 11B, 11C, 11D:
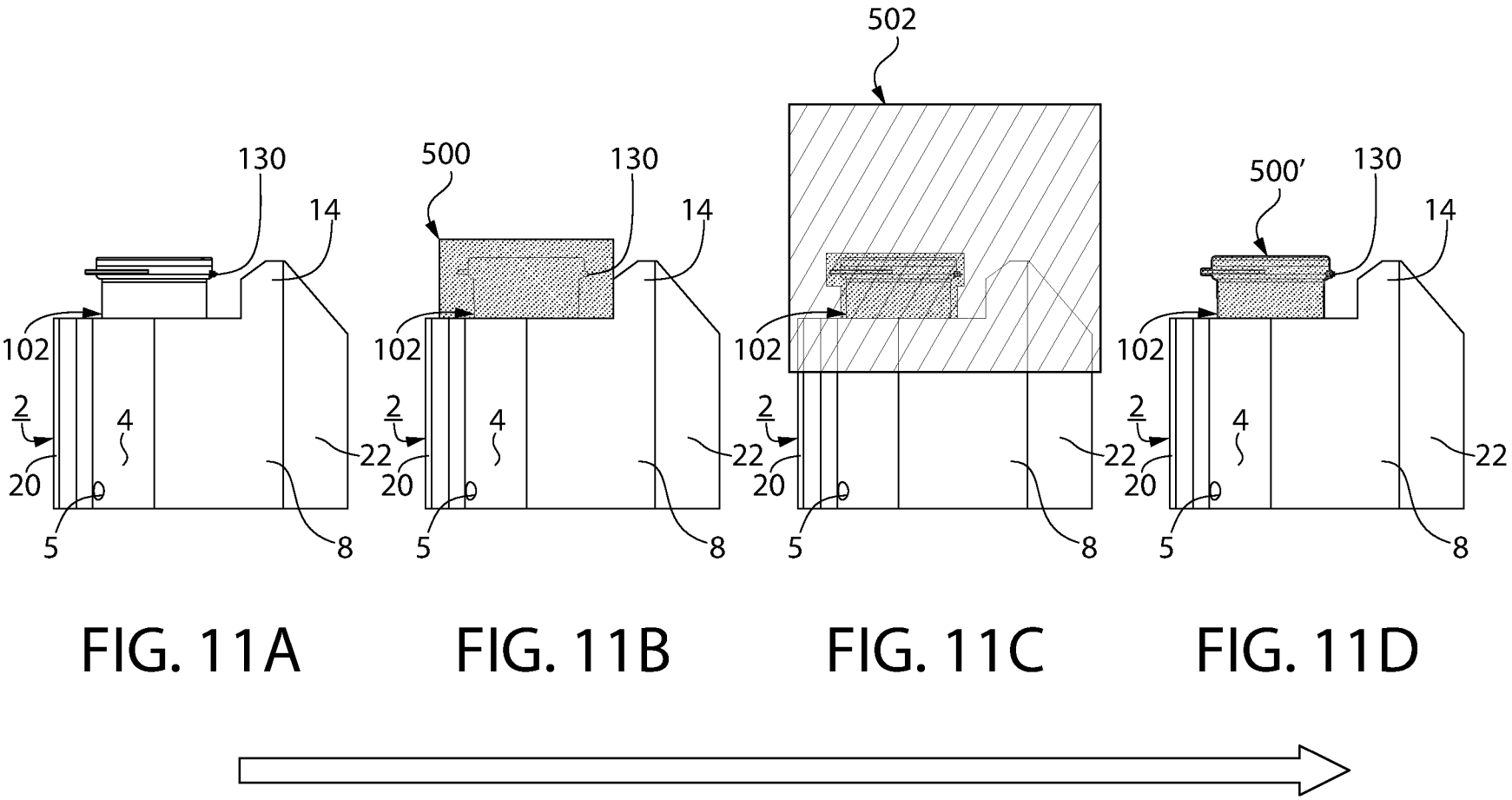
FIGS. 11A-11D show front views of the bottling line arrangement of FIGS. 10A-10D at subsequent stages during filling and sealing of the vial.

In one illustrative embodiment, and referring to FIGS. 11A-11D, once tool 400 (FIGS. 10A-10D) has passed adapter 2 and vial 100, and lid 120 is fully in the closed position, a sealing operation can reliably be performed on vial 100. Specifically, as shown in FIG. 11B, a sealing material (e.g., without limitation, heat shrink material 500) may loosely be laid on lid 120 and extended down such that heat shrink material 500 engages tail portion 20 and a top of base portion 8. Subsequently, adapter 2, vial 100, and heat shrink material 500 may be passed through a tunnel oven 502. In this manner, heat from tunnel oven 502 is configured to cause heat shrink material 500 to move from its original position to its sealed position 500' shown in FIG. 11D, a position in which it provides a reliable seal for vial 100.

Accordingly, it will be appreciated that a method of filling and sealing in a bottling line utilizing bottling line arrangement 200 includes the steps of inserting body 102 of vial 100 into receiving portion 4 of adapter 2, locating lid 120 of vial 100 on shelf portion 10 with lid 120 being in the predetermined opened position, filling the product space of body 102 of vial 100 with the product, and moving lid 120 off of shelf portion 10 and onto sidewall 106 of body 102 in order to seal the product within vial 100. The method may further include moving lid 120 off of shelf portion 10 and onto sidewall 106 to put lid 120 in a closed position. The method may also include applying heat shrink material 500, optionally a polymeric film, over lid 120 when lid 120 is in the closed position, and heating heat shrink material 500 in order to cause heat shrink material 500 to contract over lid 120 and sidewall 106, thereby forming a tamper evident mechanism. Finally, the method may also include filling and sealing a vial of a second bottling line arrangement configured the same as bottling line arrangement 200, wherein tail portion 20 engages the base portion of the adapter of the second bottling line arrangement in order to provide space between adapter 2 and the adapter of the second bottling line arrangement.

It will thus be appreciated that the disclosed concept provides for a relatively efficient and economical manner to fill, cap, and seal a vial. Specifically, known methods typically require manual labor to hold vials during filling and/or involve significantly elaborate grippers that grip vials during the filing and capping process. As such, employing multiple adapters, each holding a corresponding vial, provides a novel method to streamline filling, capping, and sealing vials. That is, vials can efficiently be filled, capped and sealed at relatively high throughput rates.

Furthermore adapter 2 uniquely allows the use of standard bottling lines and equipment for filling and capping flip-top vials, which are typically of a smaller diameter than standard bottle sizes. Adapter 2 and related components described herein properly orient flip-top vials for automated capping on typical bottling lines, thereby obviating the need for major equipment adjustments to the bottling line of the concept disclosed herein. Accordingly, adapter 2 helps vial 100 maintain proper orientation when open for filling, facilitates hassle-free travel down conveyors and while making turns on the line and assists with automated closure. While standard round bottles have no need to be maintained in any particular rotational position on automated lines, that is not the case with flip-top vials. However, adapter 2 properly orients the flip-top vial to prevent axial rotation during transport on the conveyor. Accordingly, this allows companies with standard bottling equipment to utilize the same equipment for flip-top vial filling and capping with little modification or capital investment.

The present disclosed concept has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosed concept that others can, by applying knowledge within the skill of the art, readily modify and/or adapt for various applications such specific embodiments, without undue experimentation, without departing from the general concept of the present disclosed concept. Therefore, such adaptations and modifications are intended to be within the meaning and range of equivalents of the disclosed embodiments, based on the teaching and guidance presented herein, it is to be understood that the phraseology or terminology herein is for the purpose of description and not of limitation, such that the terminology or phraseology of the present specification is to be interpreted by the skilled artisan in light of the teachings and guidance.

The breadth and scope of the present disclosed concept should not be limited by any of the above-described exemplary embodiments, but should be defined only in accordance with the following claims and their equivalents.

What is claimed is:

1. An adapter configured to hold a flip-top vial, the vial comprising a body and a lid, the body of the vial having a base and a sidewall extending therefrom, the body defining an interior comprising a product space configured for housing at least one product and having an opening leading to the interior, the lid configured to be attached to the sidewall by a hinge, the adapter comprising:

a receiving portion having an opening configured to receive the body;

a base portion extending from the receiving portion, the base portion having a shelf portion proximate the opening, the shelf portion being configured to engage the lid of the vial when the lid is in a predetermined opened position in order to maintain the lid in the predetermined opened position with respect to the body;

wherein the shelf portion comprises a first wall portion, a second wall portion disposed opposite the first wall portion, and a platform extending between the first and second wall portions; and wherein the base portion further comprises a planar surface extending from the first wall portion, the second wall portion, and the platform; and wherein the planar surface is disposed at an obtuse angle with respect to the platform.

2. The adapter according to claim 1, further comprising a tail portion extending from the receiving portion away from the base portion, wherein the base portion and the tail portion are disposed on opposing sides of the receiving portion, wherein the tail portion is configured to engage a corresponding distal exterior surface of an adjacent adapter.

3. The adapter according to claim 2, wherein the tail portion has a width; and wherein the receiving portion has a diameter at least five times greater than the width of the tail portion.

4. The adapter according to claim 1, wherein the receiving portion comprises a closed bottom and a tubular-shaped surface extending from the bottom, and wherein the tubular-shaped surface is configured to be disposed external and concentric with respect to the sidewall of the vial.

5. The adapter according to claim 4, wherein the first wall portion, the second wall portion, and the platform each extend from proximate the opening of the receiving portion away from the bottom of the receiving portion.

6. The adapter according to claim 4, wherein the receiving portion has an open top disposed opposite the bottom; and wherein a tail portion extends from proximate the bottom to proximate the top.

7. The adapter according to claim 1, wherein the receiving portion has a number of thru holes.

8. The adapter according to claim 1, wherein the adapter is a single unitary component made of a single piece of material.

9. A bottling line arrangement comprising:

the adapter according to claim 1;

a holder; and the flip-top vial, wherein the body is disposed in the receiving portion, and wherein the adapter is disposed in the holder.

10. The bottling line arrangement according to claim 9, wherein the vial is retained by the adapter in the predetermined opened position with the lid of the vial engaging the shelf portion of the adapter.

11. A method of filling and sealing in a bottling line utilizing the bottling line arrangement according to claim 9, the method comprising the steps of:

inserting the body of the vial into the receiving portion of the adapter;

disposing the lid of the vial on the shelf portion, the lid being in then predetermined opened position; and filling the product space of the body of the vial with the at least one product; and moving the lid off of the shelf portion and onto the sidewall of the body in order to seal the at least one product within the vial.

12. The method according to claim 11, further comprising the steps of:

applying a layer of heat shrink material, which is a polymeric film, over the lid when the lid is in the closed position; and heating the heat shrink material in order to cause the heat shrink material to contract over the lid and the sidewall, thereby forming a tamper evident mechanism.

13. The adapter of claim 1, wherein the opening of the receiving portion is circular in shape.

14. The adapter of claim 1, wherein the interior of the body is cylindrical in shape.

* * * * *